US006446890B1

(12) United States Patent
Font et al.

(10) Patent No.: US 6,446,890 B1
(45) Date of Patent: Sep. 10, 2002

(54) PROCESS AND APPARATUS FOR MANUFACTURING CHOPPED THERMOPLASTIC FIBERS

(75) Inventors: Dominique Font, Saint-Baldoph; Gerard Veuillen, Barberaz, both of (FR)

(73) Assignee: Vetrotex France, Chambery (FR)

( * ) Notice: Subject to any disclaimer, the term of this patent is extended or adjusted under 35 U.S.C. 154(b) by 43 days.

(21) Appl. No.: 09/675,179

(22) Filed: Sep. 29, 2000

Related U.S. Application Data

(62) Division of application No. 09/365,720, filed on Aug. 3, 1999.

(30) Foreign Application Priority Data

Aug. 3, 1998 (FR) ..... 98 09895

(51) Int. Cl.[7] ..... B02C 18/18
(52) U.S. Cl. ..... 241/101.2; 241/223
(58) Field of Search ..... 241/101.2, 235

(56) References Cited

U.S. PATENT DOCUMENTS 4,045,196 A 8/1977 Schaefer
4,467,970 A * 8/1984 Sagemuller ..... 241/101.2

FOREIGN PATENT DOCUMENTS

| | | |
|---|---|---|
| EP | 0 411 572 | 2/1991 |
| FR | 2 126 663 | 10/1972 |
| FR | 2 441 670 | 6/1980 |

* cited by examiner

*Primary Examiner*—Mark Rosenbaum
(74) *Attorney, Agent, or Firm*—Oblon, Spivak, McClelland, Maier & Neustadt, P.C.

(57) ABSTRACT

In a process for manufacturing chopped thermoplastic fibers made directly beneath bushings, especially chopped glass fibers, the thermoplastic fibers are chopped in a region in which an anvil wheel and a blade-holder wheel, rotating simultaneously, are in contact with each other. At least part of the peripheral surface of the rotating anvil wheel in contact with the blade-holder wheel is machined so as to compensate for its wear, while maintaining the anvil wheel in contact with the blade-holder wheel.

13 Claims, 1 Drawing Sheet

1
2
2
5
5
6
6
7
7
8
8
8
3
9
4
11
12
200
100

18
e0
17
100A
200
14
16
e1
15
21
22
(P1)
19
(P0)
20
13
10

PROCESS AND APPARATUS FOR MANUFACTURING CHOPPED THERMOPLASTIC FIBERS

This application is a of division of Ser. No. 09/365,720 filed Aug. 3, 1999.

BACKGROUND OF THE INVENTION

1. Field of the Invention

The present invention relates to a process for manufacturing chopped thermoplastic fibers, especially chopped glass fibers, in which the thermoplastic fibers are chopped in a region where at least an anvil wheel and a blade-holder wheel, rotating simultaneously, are in contact with each other. Although not limited to such an application, the invention will more particularly be described with reference to the manufacture of chopped glass fibers extruded directly beneath bushings.

2. Description of the Related Art

For this type of application, it is well known to cut the glass fibers continuously by using a chopping assembly consisting of two contacting wheels, one called the anvil wheel and the other the blade-holder wheel. The chopping assembly must both draw several continuous glass fibers coming from bushings at a high rate of about one or more tens of meters per second and chop each glass fiber into fragments of predetermined length.

A major problem encountered during such manufacture is associated with the phenomenon of relative wear of the contacting wheels, this wear being greater the higher their speed of rotation and the higher the contact pressure between them. In particular, wear occurs rapidly and progressively in both the cutting edge of the blades and on the external peripheral surface of the anvil wheel made of an elastomer of the polyurethane type.

Such wear means that the contact between the two wheels becomes less and less suited to drawing the glass fibers correctly and that the deformation applied by each of the blades to the external peripheral surface of the anvil wheel no longer allows the fibers to be broken cleanly. Consequently, the quality of the produced chopped fibers deteriorates progressively.

Hitherto, this difficulty has been overcome by accepting a somewhat degraded quality of chopped fiber, and when this degradation is excessive, by frequently stopping the production so as to carry out a wheel change. Quite obviously, this change is detrimental to the production yield.

SUMMARY OF THE INVENTION

It is an object of the invention to improve the production yield of chopped fibers of the type mentioned above without thereby degrading their quality.

To achieve this and other objects, the invention comprises a is process for manufacturing chopped thermoplastic fibers, especially chopped glass fibers, in which the thermoplastic fibers are chopped in a region where at least an anvil wheel and a blade-holder wheel, rotating simultaneously, are in contact with each other. At least part of the peripheral surface of the rotating anvil wheel in contact with the blade-holder wheel is machined so as to compensate for its wear, while maintaining the anvil wheel in contact with the blade-holder wheel.

The machining reduces the thickness of the anvil wheel, preferably by grinding the peripheral surface of the wheel.

The machining of the invention is a simple and effective solution to the conventional problems. To achieve this solution, the inventors have determined that the wheel thickness change was necessitated only for the anvil wheel, the wear of the material (polyurethane) of whose external peripheral surface is high, while the wear of the cutting edge of the blades was lower. They have discarded the solution of using a more wear-resistant material for the anvil wheel, this solution being tricky to develop and difficult to apply under industrial conditions.

There are many advantages provided by the invention. First, because of the direct machining, the frequency of wheel changes is considerably reduced, hence a significant increase in production time. Moreover, this increase is all the greater since the production is not interrupted during direct machining.

Next, the costs associated with equipment consumption are also considerably reduced. In fact, according to the prior art, the cost of consumables associated with frequently reconditioning the wheels was far from negligible, especially by frequently putting the anvil wheel on a conventional machining device, such as a lathe, etc.

Furthermore, the quality of the chopped fiber obtained is much more constant.

In addition, direct in-situ machining makes it possible to ensure that there is always perfect coaxiality between the external peripheral surface of the anvil wheel and the rotation spindle which supports it, something which might not conventionally be the case insofar as, especially when refitting the anvil wheel whose wear had been compensated for on a conventional machining device, there was always a risk of the axis of symmetry of this wheel not being coincident with the rotation spindle.

Finally, regenerating the external peripheral surface of the anvil wheel results in a reduction in the wear of the blades, this wear being much less since they no longer suffer abrasion due to the thermoplastic particles resulting from the chopping, which particles are no longer embedded in the machined surface.

According to an advantageous characteristic of the invention, the fibers are drawn using the assembly formed by the anvil wheel and the blade-holder wheel.

Preferably, prior to chopping, the thermoplastic fibers are arranged in such a way that they bear on part of the peripheral surface of one of the wheels, preferably the anvil wheel. Such an arrangement helps in the frictional drawing and entrainment of the fibers on the anvil wheel.

Preferably still, the thermoplastic fibers are obtained by a direct fiberizing process.

The invention also relates to an apparatus for implementing the process that has just been described. This apparatus is noteworthy in that it comprises at least an anvil wheel and a blade-holder wheel in contact with each other; and a device for machining at least part of the external peripheral surface of the anvil wheel.

Advantageously, the apparatus also comprises a device for arranging the fibers such that they bear on part of the peripheral surface of one of the wheels, preferably the anvil wheel.

According to another characteristic of the invention, the anvil wheel consists of a roll covered over at least part of its circumference with a covering made of a polymer material, especially an elastomer of the polyurethane type.

Advantageously, the device for carrying out the machining of the aforementioned apparatus comprise at least one abrasive wheel. Of course, the device for carrying out the machining may comprise a cutting tool such as a blade.

However, the abrasive wheel is perfectly suited to the machining according to the invention insofar as it constitutes a simple and compact tool capable of "regenerating," that is making uniform again, the external peripheral surface of the anvil wheel running with a high peripheral velocity.

According to an additional characteristic, the abrasive wheel consists of a cylinder, preferably made of metal, the peripheral surface of which is covered with a multitude of grit particles of the diamond type. This particular grinding-wheel structure makes it possible to abrade without the risk of slip between the surfaces in question.

According to another characteristic, the movement of the abrasive wheel must allow the grinding wheel to machine it over the entire peripheral surface simultaneously, working in a so-called plunge-grinding mode.

In order to further optimize the work of the machining device, the operation and, where necessary, the movement of the device for carrying out the machining is responsive to a controller receiving inputs from, e.g., a device for checking the external peripheral surface finish of the anvil wheel, such as an optical sensor or a roughness measurement sensor, or to a device for checking the quality of the chopped fibers.

In order to avoid any risk of the particles resulting from the machining fouling the various surrounding elements and, as the case may be, getting mixed up with the end-product, it is preferable for the apparatus to furthermore comprise a device for collecting them. These particles may either be "chips" coming from particles of elastomer or may be abrasive particles liberated from the abrasive wheel.

The recovery device may preferably consist of at least one suction nozzle, preferably located immediately downstream of the device for carrying out the machining. The term "downstream" should be understood to mean here the relative position with respect to the direction of rotation of the anvil wheel. In fact, the position of the suction nozzle will be advantageously chosen depending on the main direction of ejection of the particles resulting from the machining. This direction will, of course, depend on the direction of relative rotation of the grinding wheel with respect to that of the anvil wheel, as well as on its relative velocity.

As mentioned previously, the invention is particularly applicable to the manufacture of chopped glass fibers extruded directly beneath bushings, especially those having a fiber diameter of between 5 and 24 $\mu$m and/or those having a length of between 1.5 and 15 mm.

BRIEF DESCRIPTION OF THE DRAWINGS

Further details and advantageous characteristics will emerge from reading the detailed description of an illustrative but non-limiting example with reference to the figures in which.

DETAILED DESCRIPTION OF THE PREFERRED EMBODIMENT

Figure 1:
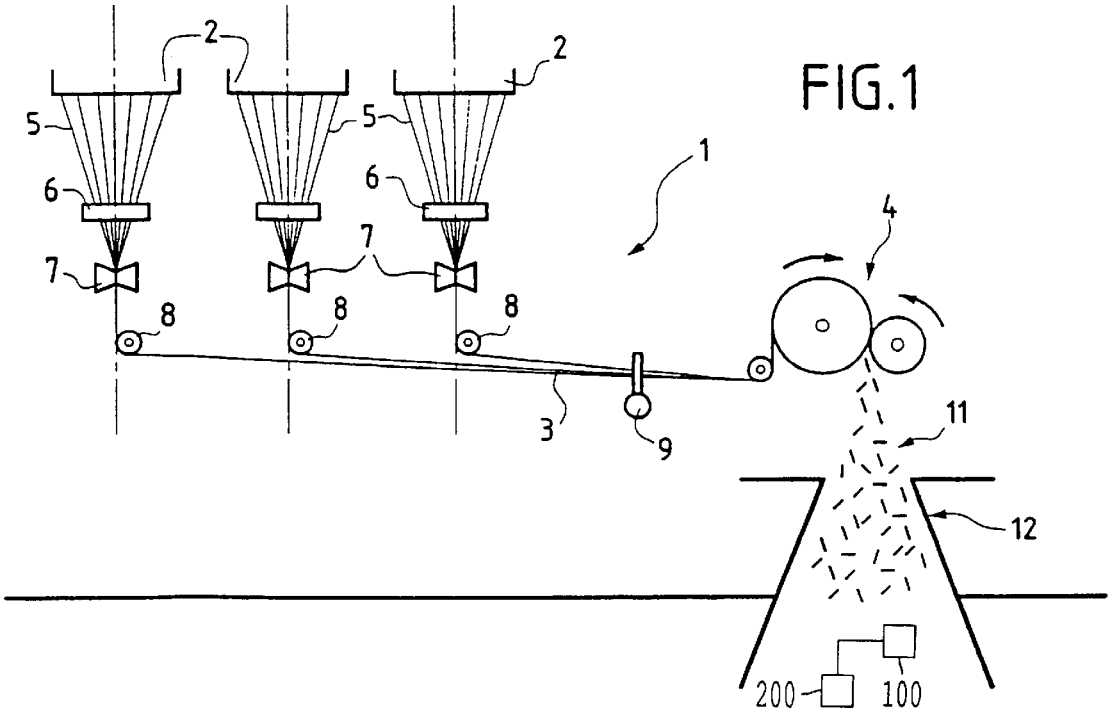
FIG. 1 is a schematic view of a plant, to which the invention may be applied, for manufacturing chopped glass fibers directly beneath bushings.

FIG. 1 is a schematic view of a plant for manufacturing chopped glass fibers directly beneath bushings. This plant 1 comprises a series of bushings 2 from which are continuously drawn glass fibers 3, and a chopping assembly 4 lying downstream of the plant with respect to the fiber-drawing direction.

Each bushing 2 is supplied with molten glass by a feed device (not shown) and is provided in its lower part with a multiplicity of orifices from which a large number of fibers 5 are gathered in the form of sheets. These fibers are then coated with a size, in a manner known per se, by means of a coating device 6, and are gathered in the form of fibers 3 using small combining rollers 7. The fibers 3 thus formed are brought, after passing over small deflection rollers 8, to a guiding device 9 and are introduced into a chopping machine 10 according to the invention (corresponds in location to the chopping assembly 4), explained in detail below. The chopped fibers 11 are collected by a receiving device 12.

Figure 2:
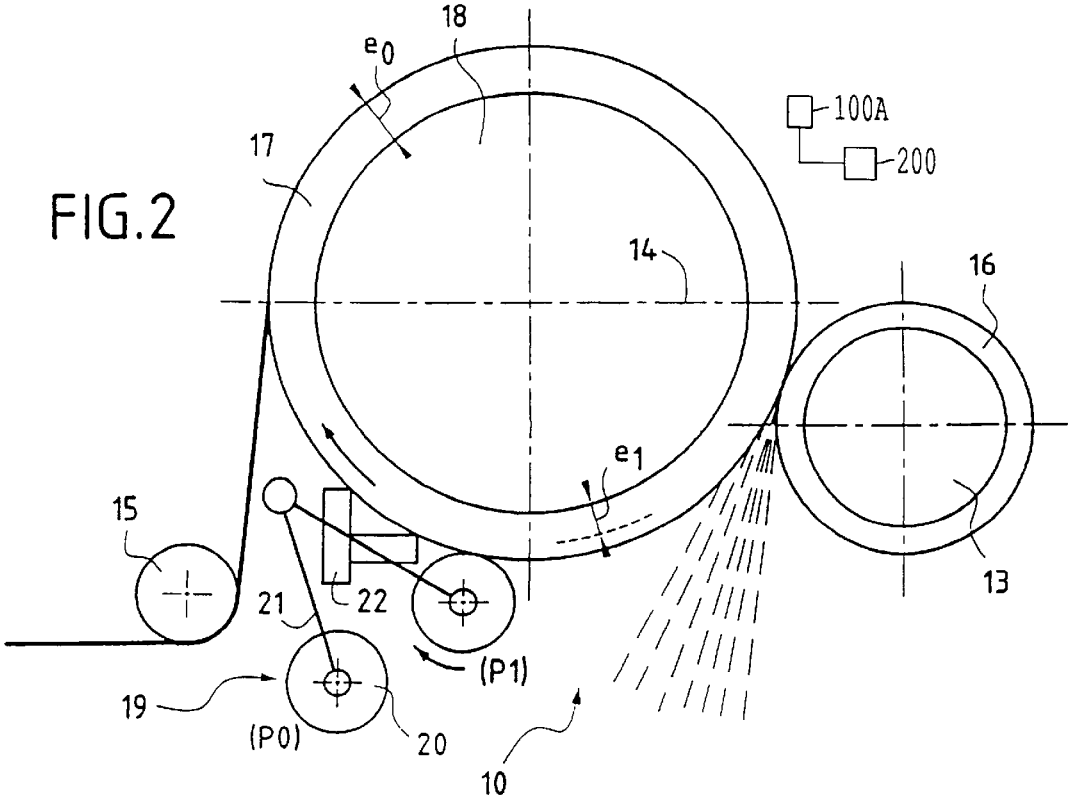
FIG. 2 is a schematic view of an apparatus according to the invention.

FIG. 2 is a schematic view of the chopping machine 10 according to the invention. This chopping machine 10 first comprises a blade-holder wheel 13 and an anvil wheel 14, and a small feed roller 15 which guides the fibers such that they bear on the peripheral surface of the anvil wheel 14 over a great length and therefore are drawn and entrained by friction. The blade-holder wheel 13 is provided on its periphery with blades 16 extending generally parallel to the rotational axis so as to cut the fibers. The anvil wheel 14 is coated with an elastomer cover 17 having a thickness $e_0$, molded on a metal mandrel 18. The wheels are driven so that the blades of the rotating wheel 13 contact the cover 17 in such a way that the fibers are chopped in the contact area.

According to the invention, this chopping machine 10 comprises, in its lower part, an abrasive device 19 in a region where there is no risk of disturbing the chopping of the fibers 3. This abrasive device 19 is capable of machining the external surface of the elastomer cover 17 of the anvil wheel 14 so as to smooth the surface by reducing its thickness. This device comprises an abrasive wheel 20 in the form of a metal cylinder, the peripheral surface of which is covered with a multitude of diamond grit particles, placed at the end of a lever arm 21. The abrasive wheel is driven in rotation. The movement of the lever arm allows the grinding wheel to come into contact with the elastomer cover 17. A suction nozzle 22 is also placed in the immediate vicinity of the cover 17 to remove fiber or abrasive particles which may adhere to the cover 17.

The operation of the chopping machine 10 according to the invention will now be explained. It should be pointed out that it is not the manner in which the chopping is carried out that is described but rather the mode of action of the abrasive device 19.

Placed downstream of the receiving device 12 is a sensing device 100 which checks and monitors the density of the chopped fibers 11 over time. Any reduction in density is directly related to the degradation of the surface finish of the elastomer cover 17. When the density falls below a predetermined minimum threshold, the operation of the abrasive wheel 20 is initiated, as well as the rotation of the lever arm 21 so that the grinding wheel passes from its initial position $P_0$ spaced from the elastomer cover 17 to its final position $P_1$ which brings it into contact with the cover and allows it to perform plunge grinding. For example, an electronic control device 200 such as a programmable digital computer may store the predetermined minimum threshold in a memory, and output signals to a motor for moving the lever arm 21 and to a motor for rotatably driving the grinding wheel 20, when signals from the density sensing device indicate that the sensed density is less than the predetermined minimum threshold.

Alternatively, an optical sensor or a roughness measurement sensor 100A may directly measure the surface roughness of the cover 17.

This machining contact lasts for a predefined period of time which is long enough to remove from the periphery of the cover 17 an amount of elastomer such that the surface finish of the latter becomes uniform again, its thickness going from $e_0$ to $e_1$. Due to the elasticity of the cover material, the initial contact pressure of the blades 16 on the cover may be such that the blades are able to contact the cover 17 to chop the fibers, even after the thickness reduction of the cover 17 due to the machining operation of the invention.

It goes without saying that many modifications may be made without thereby departing from the scope of the invention.

What is claimed is:

1. An apparatus for manufacturing chopped thermoplastic fibers, comprising:

an anvil wheel and a blade-holder wheel having external peripheral surfaces in rotatable contact with each other;

a machining element positionable to machine at least part of the external peripheral surface of the anvil wheel, while maintaining the anvil wheel in contact with the blade-holder wheel; and means for determining the presence of a condition requiring the machining of the anvil wheel.

2. The apparatus according to claim 1, further comprising a guide element positioned to guide the fibers such that they bear on part of the peripheral surface of the anvil wheel.

3. The apparatus according to claim 1, wherein the anvil wheel comprises a roll covered over at least part of its circumference with a covering made of a polyurethane elastomer.

4. The apparatus according to claim 1, wherein the machining element comprises at least one abrasive wheel.

5. The apparatus according to claim 4, wherein said abrasive wheel comprises a cylinder having a peripheral surface covered with a multitude of grit particles.

6. The apparatus according to claim 4, wherein the abrasive wheel is mounted for selective movement towards and away from the peripheral surface of the anvil wheel.

7. The apparatus according to claim 1, wherein said means for determining comprises a sensor positioned for checking a characteristic of the chopped fibers, and further comprising a controller which moves the abrasive wheel based on the sensed characteristic.

8. The apparatus according to claim 1, further comprising a device positioned to collect particles resulting from the use of the machining element.

9. The apparatus according to claim 8, wherein the collecting device comprises at least one suction nozzle located immediately downstream of the machining element.

10. An apparatus for manufacturing chopped thermoplastic fibers, comprising:

an anvil wheel and a blade-holder wheel having external peripheral surfaces in rotatable contact with each other;

means for machining at least part of the external peripheral surface of the anvil wheel while maintaining the anvil wheel in contact with the blade-holder wheel; and means for determining the presence of a condition requiring the machining of the anvil wheel.

11. The apparatus according to claim 10, wherein the machining means comprise a grinding wheel further comprising means for selectively moving the grinding wheel towards and away from the peripheral surface of the anvil wheel.

12. The apparatus according to claim 10, wherein said means for determining comprises means for checking a characteristic of the chopped fibers, and further comprising controller means for moving the abrasive wheel based on the sensed characteristic.

13. The apparatus according to claim 11, wherein said means for determining comprises means for checking a characteristic of the anvil wheel, and further comprising controller means for moving the abrasive wheel based on the sensed characteristic.

* * * * *